US009039253B2

(12) United States Patent
Jin et al.

(10) Patent No.: US 9,039,253 B2
(45) Date of Patent: May 26, 2015

(54) ILLUMINATION DEVICE

(75) Inventors: Joong Hun Jin, Masan-si (KR); Min Ho Cha, Seoul (KR); Hyeong Won Yun, Yongin-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 111 days.

(21) Appl. No.: 13/452,417

(22) Filed: Apr. 20, 2012

(65) Prior Publication Data

US 2012/0268922 A1 Oct. 25, 2012

(30) Foreign Application Priority Data

Apr. 22, 2011 (KR) ..... 10-2011-0037657

(51) Int. Cl.

| | |
|---|---|
| ***F21V 15/00*** | (2006.01) |
| ***F21S 8/04*** | (2006.01) |
| ***F21V 15/01*** | (2006.01) |
| ***F21V 17/10*** | (2006.01) |
| ***F21V 17/18*** | (2006.01) |
| ***F21V 23/02*** | (2006.01) |

(52) U.S. Cl.

CPC . *F21S 8/04* (2013.01); *F21V 15/01* (2013.01); *F21V 17/104* (2013.01); *F21V 17/107* (2013.01); *F21V 17/18* (2013.01); *F21V 23/02* (2013.01); *F21V 23/026* (2013.01)

(58) Field of Classification Search

USPC ..... 362/362, 364, 374, 147, 404, 367, 150, 362/154

See application file for complete search history.

(56) References Cited

U.S. PATENT DOCUMENTS

| | | | | | |
|---|---|---|---|---|---|
| 2,717,955 | A | * | 9/1955 | McGinty et al. | 362/147 |
| 2,857,508 | A | * | 10/1958 | Klugman | 362/364 |
| 3,109,599 | A | | 11/1963 | Franck et al. | |
| 4,263,639 | A | * | 4/1981 | Schacht | 362/147 |
| 4,791,539 | A | * | 12/1988 | Ewing | 362/659 |
| 4,862,334 | A | * | 8/1989 | Ivey et al. | 362/149 |
| 5,136,493 | A | * | 8/1992 | Straus et al. | 362/373 |
| 5,829,866 | A | | 11/1998 | Stegeman | |
| 5,842,775 | A | * | 12/1998 | Roorda et al. | 362/294 |

(Continued)

FOREIGN PATENT DOCUMENTS

| | | | |
|---|---|---|---|
| DE | 197 06 896 | A1 | 8/1998 |
| DE | 10 2007 063 335 | A1 | 7/2009 |

(Continued)

OTHER PUBLICATIONS

Extended European Search Report issued in European Patent Application No. EP 12165030.3 dated Jun. 3, 2013.

*Primary Examiner* — John A Ward

(74) *Attorney, Agent, or Firm* — McDermott Will & Emery LLP

(57) ABSTRACT

Provided is an illumination device including a light source, a power supply to supply power to the light source, a housing including one side formed to be open, and including the light source and the power supply in the housing, at least one diffusion cover, disposed on the open side of the housing, through which light from the light source passes, and a power cover, disposed on the open side of the housing, to cover one side of the power supply. The illumination device may minimize a number of components or tools used for installing the illumination device. The illumination device may be readily installed by changing a structure and components included in the illumination device may be readily changed and repaired.

13 Claims, 11 Drawing Sheets

(56) References Cited

U.S. PATENT DOCUMENTS

| | | | | |
|---|---|---|---|---|
| 5,988,825 | A * | 11/1999 | Masters et al. | 362/20 |
| 6,050,708 | A * | 4/2000 | Roorda | 362/375 |
| 6,422,720 | B2 * | 7/2002 | Fischer et al. | 362/374 |
| 7,645,047 | B2 * | 1/2010 | Martinez | 362/20 |
| 7,682,051 | B2 * | 3/2010 | Xiao et al. | 362/364 |
| 7,824,046 | B2 * | 11/2010 | Martinez | 362/20 |
| 8,777,448 | B2 * | 7/2014 | Shimizu et al. | 362/235 |
| 2007/0211457 | A1 | 9/2007 | Mayfield et al. | |
| 2008/0002399 | A1 | 1/2008 | Villard et al. | |
| 2009/0002399 | A1 * | 1/2009 | Rao et al. | 345/660 |
| 2009/0279297 | A1 | 11/2009 | Plunk | |
| 2010/0232155 | A1 * | 9/2010 | Wang | 362/235 |
| 2010/0259938 | A1 | 10/2010 | Schenk et al. | |

FOREIGN PATENT DOCUMENTS

| | | | |
|---|---|---|---|
| KR | 10-2009-0012118 | A | 2/2009 |
| KR | 10-2010-0079538 | A | 7/2010 |

* cited by examiner

ILLUMINATION DEVICE

CROSS-REFERENCE TO RELATED APPLICATION

This application claims the priority benefit of Korean Patent Application No. 10-2011-0037657, filed on Apr. 22, 2011, in the Korean Intellectual Property Office, the disclosure of which is incorporated herein by reference.

BACKGROUND

1. Field

Example embodiments relate to an illumination device that is readily installed and maintained, and more particularly, to an illumination device that minimizes a number of components or tools for installing the illumination device by changing an internal structure of the device and a structure for opening and closing the device and thus, the illumination device may be readily installed and components included in the illumination device may be readily changed and maintained.

2. Description of the Related Art

Generally, fluorescent lamps or incandescent lamps have been used commonly as illumination devices, and fluorescent lamps having an excellent intensity of illumination and power efficiency are gaining popularity in usage. Most illumination devices used in homes and offices are fluorescent lamps, for example, a ceiling light that is configured to include a lampshade and a fluorescent lamp, corresponding to a glass tube, an inside wall of which is coated with a fluorescent material.

As demand for lighting has increased and lighting has been applied to various application fields, an amount of total power consumption has increased and an amount of load has also increased. Therefore, various attempts at reducing the power consumption have been conducted, and the use of an illumination device including a high brightness light emitting diode (LED) as a light source has increased while taking an amount of power consumption, a lifespan, a brightness, a diffusion range of a bulb, and the like into account.

Illumination devices have different light distribution structures or different installation structures based on an environment, such as an installation place or location. Generally, a planar illumination device that protrudes relatively modestly from the ceiling is used as an illumination device installed inside offices, department stores, and public facilities.

A space may be needed to install the planar illumination device, and the planar illumination device may be classified as a T-BAR shape and an M-BAR shape, based on a type of support for the illumination device in the space.

Various tools and components are used to install and fix the planar illumination device, and an operation of separating a front cover using a screwdriver or a separate tool or an operation of detaching the entire illumination device from the ceiling may need to be performed to maintain and repair the planar illumination device.

SUMMARY

An aspect of example embodiments provides an illumination device that minimizes a number of components or tools used for installing the illumination device and thus, the illumination device may be readily installed and components included in the illumination device may be readily changed and repaired.

Another aspect of example embodiments provides an illumination device that changes a combination structure of the illumination device so that components included in the illumination device may be detached without need for a separate tool and a corresponding component may be selectively checked when the illumination device is repaired.

The foregoing and/or other aspects are achieved by providing an illumination device, including a light source, a power supply to supply power to the light source, a housing including one side formed to be open, and including the light source and the power supply in the housing, at least one diffusion cover, disposed on the open side of the housing, through which light from the light source passes, and a power cover, disposed on the open side of the housing, to cover one side of the power supply.

The power cover may be combined with the housing to open and close.

The power cover may be formed to overlap at least one portion of the at least one diffusion cover when the housing is closed.

A portion of the power cover overlapping the at least one portion of the at least one diffusion cover may be formed to protrude into an internal space of the housing, and may press the at least one diffusion cover when the housing is closed.

The foregoing and/or other aspects are achieved by providing an illumination device, including a light source, a power supply to supply power to the light source, a housing including the light source and the power supply in the housing, including one side formed to be open, and including a combination assistance portion formed to be adjacent to the open side, at least one diffusion cover, disposed on the open side of the housing, through which light from the light source passes, a power cover, disposed on the open side of the housing, to cover one side of the power supply, and a combination module to combine the at least one diffusion cover with the combination assistance portion, and the combination module is configured to combine the at least one diffusion cover with the combination assistance portion, or to combine the at least one diffusion cover and the power cover with the combination assistance portion.

The combination module may include a plurality of connecting portions, each connecting portion formed to be a long column shape that is long in one direction, and including a body member combined with at least one of the at least one diffusion cover and the power cover, and corresponding connecting locking members to connect the plurality of connecting portions that are adjacent to each other, and fixing the plurality of connecting portions on the combination assistance portion.

The connecting portion may further include a wing member extending from one side of the body member, and the wing member may prevent the combination assistance portion from being visually exposed at a predetermined direction when the combination module is combined with the housing.

Each locking member may include a corner member having a shape of a cross section including a quarter round or two sides that are orthogonal, two insertion members extending from the corner member to be orthogonal each other, and inserted to corresponding insertion spaces of connecting portions, and a lever member connected to the corner member, and formed to be detachable from at least one portion of the combination assistance portion.

The lever member may be combined, with the corner member, to be rotatable, and may be combined with the combination assistance portion or detached from the combination assistance portion according to the rotation.

The two insertion members may be inserted to the corresponding insertion spaces based on a forced-fit scheme, and may connect the connecting portions.

The combination module may include one side formed to be open, and may have an insertion space inside the combination module, and may combine at least one of an outline of the at least one diffusion cover and an outline of the combination assistance portion by inserting at least one of the sides into the insertion space.

Each diffusion cover may be formed to be a quadrangle shape, the combination module may be formed to have a shape that receives three adjacent sides of the diffusion cover, and the three adjacent sides and at least one portion of the combination assistance portion are sliding-combined with the insertion space.

Additional aspects of embodiments will be set forth in part in the description which follows and, in part, will be apparent from the description, or may be learned by practice of the disclosure.

EFFECT

The example embodiments may include an illumination device that minimizes a number of components or tools used for installing the illumination device and thus, the illumination device may be readily installed and components included in the illumination device may be readily changed and repaired.

The example embodiments may include an illumination device that changes a combination structure so that components included in the illumination device may be detached without a separate tool, and a corresponding component may be selectively checked when the illumination device is repaired. A power cover may readily open and close, such that access from an external environment to a power supply disposed in an internal space of a housing may be readily performed when the power cover opens and thus, the power supply may be maintained and repaired by opening and closing the power cover, as opposed to dissembling the whole illumination device.

The example embodiments may include an illumination device that may combine a diffusion cover with a housing without using a separate component such as a screw and thus, may prevent a deformation of a product due to combination using the screw and may provide esthetic satisfaction.

The example embodiments may include an illumination device that may selectively open and close a power cover or a diffusion cover without using a separate tool and thus, an operation time is shortened and efficiency may be improved.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
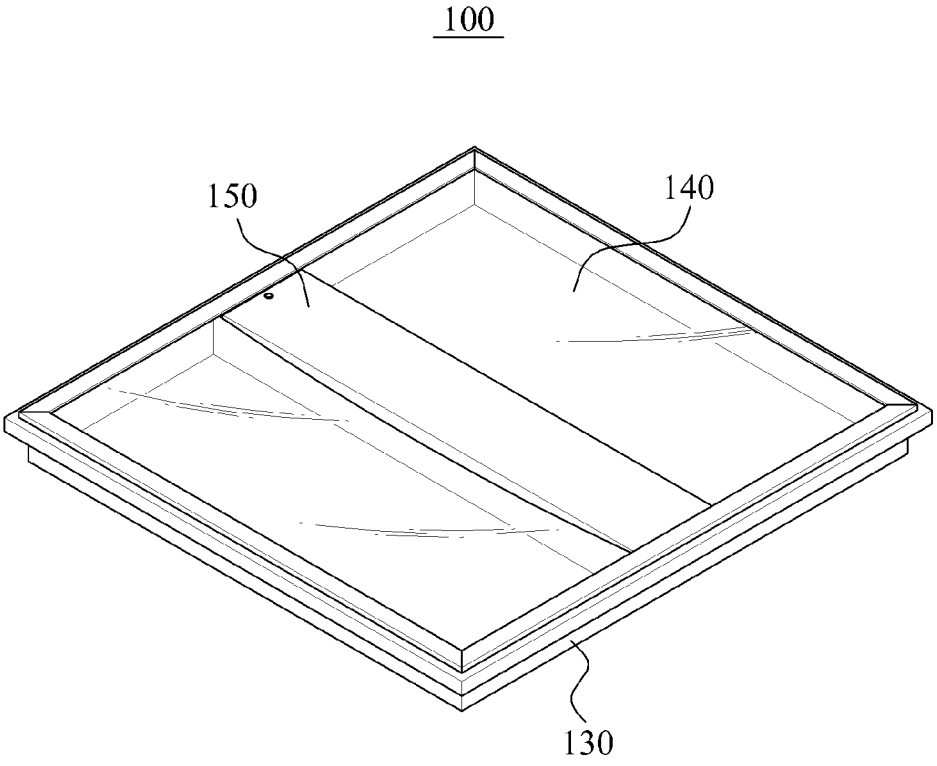
FIG. 1 is a perspective view of an illumination device according to example embodiments.

Reference will now be made in detail to embodiments, examples of which are illustrated in the accompanying drawings, wherein like reference numerals refer to the like elements throughout. Embodiments are described below to explain the present disclosure by referring to the figures.

Figure 2:
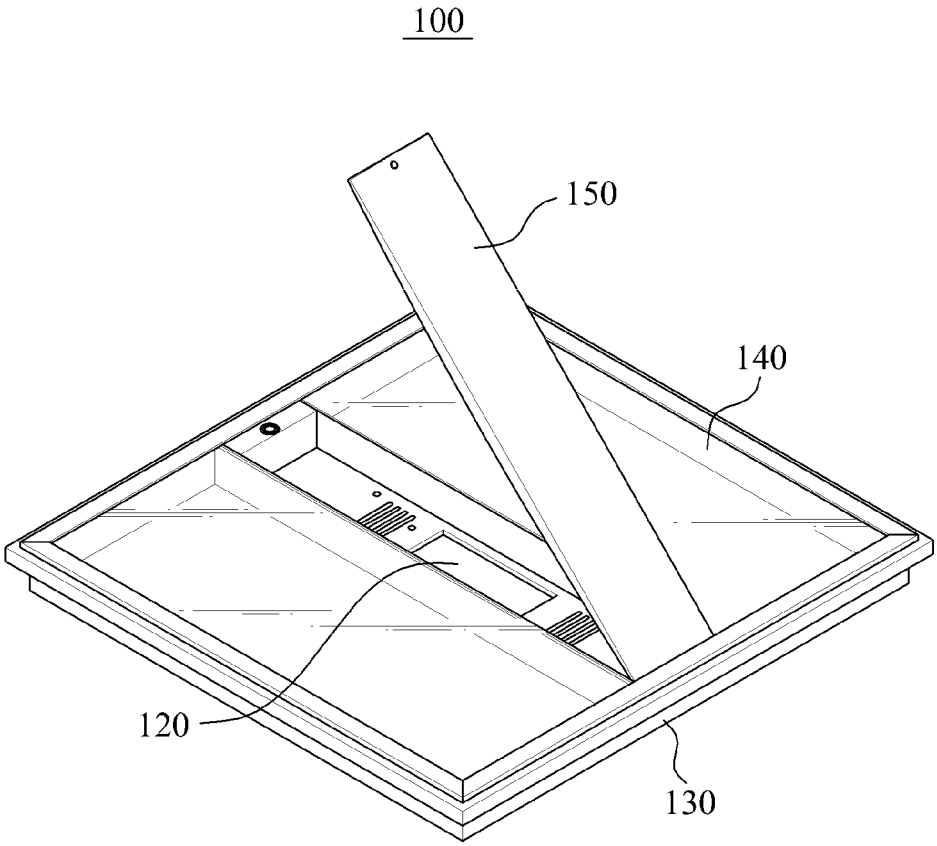
FIG. 2 is a perspective view of an open power cover of the illumination device of FIG. 1.
Figure 3:
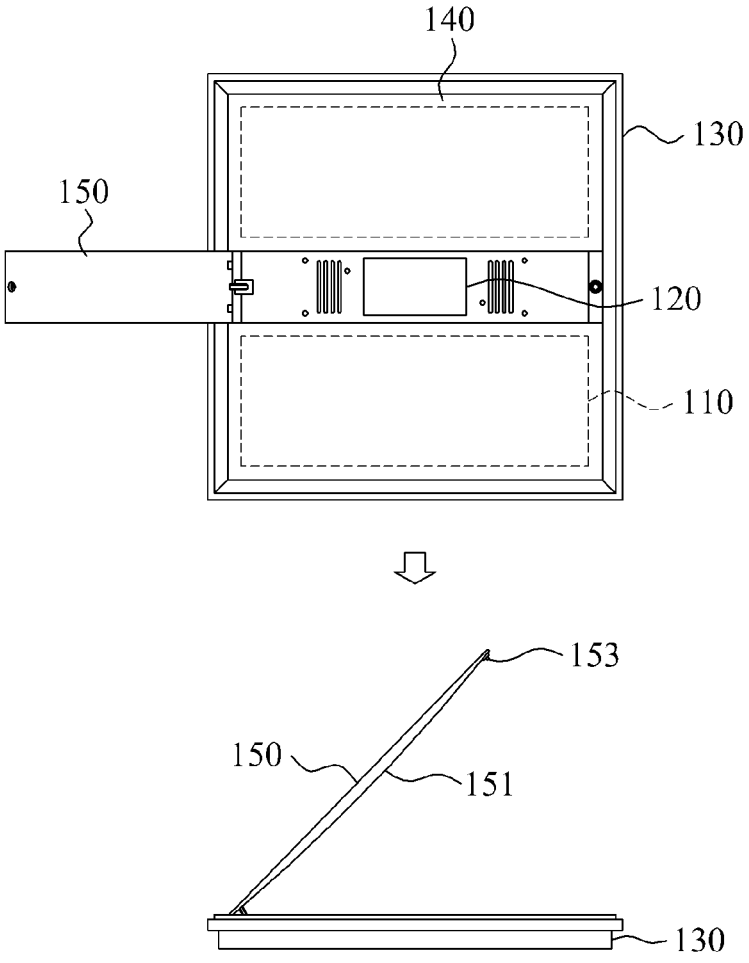
FIG. 3 is a planar view of the illumination device of FIG. 2 viewed from a lower portion.

FIG. 1 illustrates an illumination device 100 according to example embodiments, FIG. 2 illustrates an open power cover of the illumination device 100 of FIG. 1, and FIG. 3 illustrates the illumination device 100 of FIG. 2 viewed from one side.

The illumination device 100 includes a light source 110, a power supply 120, a housing 130, a diffusion cover 140, and a power cover 150.

The light source 110 may be configured as a fluorescent lamp that is a common light source or may be configured as a light emitting diode (LED). The light source 110 may be configured as a planar LED module that corresponds to a light emitting device module including a light emitting device on a printed circuit board (PCB). Even though the light source 110 is configured to have a planar shape, the configuration is not limited thereto.

The power supply 120 may be configured to supply power to the light source 110. For example, when the light source 110 is configured as a light emitting device module including the LED, the power supply 120 may be configured as a switching mode power supply (SMPS) that converts an alternating current (AC) commonly supplied from an exterior to a direct current (DC) so that a voltage is converted to be appropriate for a light emitting condition of the light source 110.

Even though the housing 130 is configured to include a space for receiving the light source 110 and the power supply 120, and to have a hexahedral shape of which one side is open, the configuration is not limited thereto.

In this example, the light source 110 may be disposed in the housing 130, so as to emit light to an open side of the housing 130. In the example embodiments, the light source 110 may be configured as two planar light emitting modules, and the two planar light emitting modules are disposed on both sides to be symmetrical to each other and the power supply 120 may be disposed between the two planar light emitting modules.

In this example, the power supply 120 may protrude into an internal space of the housing 130 and thus, a reflection member may be included, in a direction corresponding to the light source 110, to reflect light from the light source 110 so that a shade generated due to both a shape of the power supply 120 and a light from the light source 110 may be prevented or light may be diffused effectively. However, the configuration is not limited thereto. For example, the light source 110 may protrude instead of the power supply 120 or one exposed side of the power supply 120 and a light emitting side of the light source 110 may be disposed on the same plane.

The power supply 120 may be disposed in an internal space of the housing 130. Here, the power supply 120 may be configured so as not to be disposed along a path of light emitted from the light source 110, or may be configured to prevent, using the reflection member, a dark space caused by the power supply 120 from being generated when the power supply 120 is disposed along the path.

The diffusion cover 140 may be disposed on the open side of the housing 130 and may be configured as a transparent plastic material or a translucent plastic material so that light from the light source 110 may pass through the diffusion cover 140 or may be diffused by the diffusion cover 140. Even though the diffusion cover 140 may be disposed on both sides to correspond to a plurality of planar light emitting modules, that is the light source 110, in the example embodiments, the configuration may not be limited thereto. The diffusion cover 140 may be disposed to be spaced at a predetermined distance away from the light source 110 so that a dark space is prevented from being formed on the diffusion cover 140 or an image is prevented from being created on the diffusion cover 140.

As an example, the power cover 150 may be disposed on the open side of the housing 130 to cover one side of the power supply 120. That is, the power cover 150 may be disposed on the open side of the housing 130 that corresponds to a location where the power supply 120 is disposed so that the power supply 120 is prevented from being exposed to an external environment.

In this example, the power cover 150 may be configured as an opaque material to prevent the power supply 120 from being visually exposed, as opposed to the diffusion cover 140, and may be configured to open and close independently from the diffusion cover 140.

The power cover 150 may be hinge-combined with one side of the housing 130 and may be configured to perform a rotational motion with respect to the housing 130, that is, to open and close.

Even though the power cover 150 is hinge-combined with the housing 130 to open and close based on the rotational motion, the configuration is not limited thereto. For example, the power cover 150 may be combined with the housing 130 based on a sliding scheme, a screw combination structure, and the like. The configuration of the power cover 150 may be freely changed when the power cover 150 is formed separately from the diffusion cover 140 and is able to independently open and close.

The power cover 150 may have a protrusion 151 that protrudes into an internal space of the housing 130 in a configuration in which the power cover 150 is combined with the housing 130. When the power cover 150 closes the housing 130, that is, when the power cover 150 covers the power supply 120, the power cover 150 may be formed to overlap a portion of the diffusion cover 140.

As an example, both ends of the power cover 150 may be formed to overlap the portion of the diffusion cover 140, that is, the both ends are in a direction of the diffusion cover 140.

In this example, the diffusion cover 140 may be configured as a plastic material and thus, predetermined elastic deformation of the diffusion cover 140 may be performed. When the power cover 150 rotates in a direction for closing the housing 130 to isolate the power supply 120 from an external environment, the protrusion 151 may press the portion of the diffusion cover 140 that overlaps the power cover 150, and thus, the diffusion cover 140 may be deformed based on a protruding shape of the protrusion 151.

Even though a cross section of the protrusion 151 protrudes in a curved shape having a predetermined curvature as illustrated in FIGS. 2 and 3, it is not limited thereto. That is, the protrusion 151 may be freely deformed in various shapes including a combination of a straight line and a curve, an intermittently protruding shape, and the like.

The diffusion cover 140 may be firmly fixed based on the described structure, and the shape may be freely deformed, so that esthetic satisfaction associated with the illumination device 100 may increase.

As an example, the power cover 150 may close the housing 130 and may be fixed, by a fixing key 153, on the housing 130 so that rotation may be restricted. The fixing key 153 may be configured as a button-type fixing device that is used commonly. The button-type fixing device may be configured to operate based on a push-button scheme, that is, the button-type fixing device may be opened by pushing a button and may be closed by pushing the button again. However, the configuration may not be limited thereto. The configuration may be freely changed when user is able to open the closed power cover 150 without a separate tool or device.

Here, the power cover 150 may readily open and close based on the configuration of the illumination device 100 and the power supply 120 may be disposed in an internal space of the housing 130. Also, when the power cover 150 opens, the configuration may allow access from an external environment to the power supply 120 so that the power supply 120 may be readily maintained and repaired by opening and closing the power cover 150, as opposed to dissembling the whole illumination device 100.

When the power cover 150 opens and closes without using a separate tool, the power cover 150 readily opens and thus, an operation time is shortened and efficiency may be improved.

Figure 4:
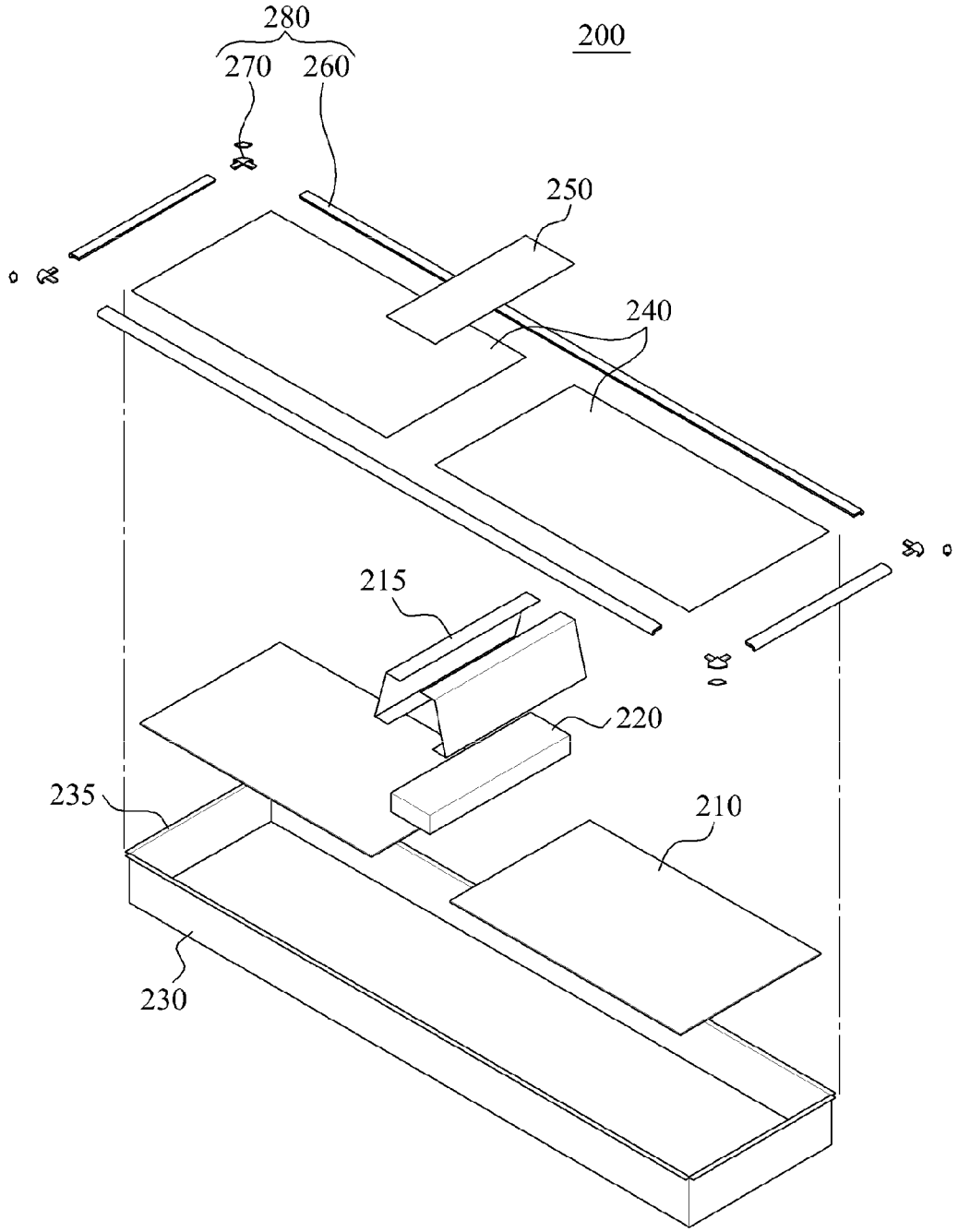
FIG. 4 is an exploded perspective view of an illumination device according to other example embodiments.
Figure 5A:
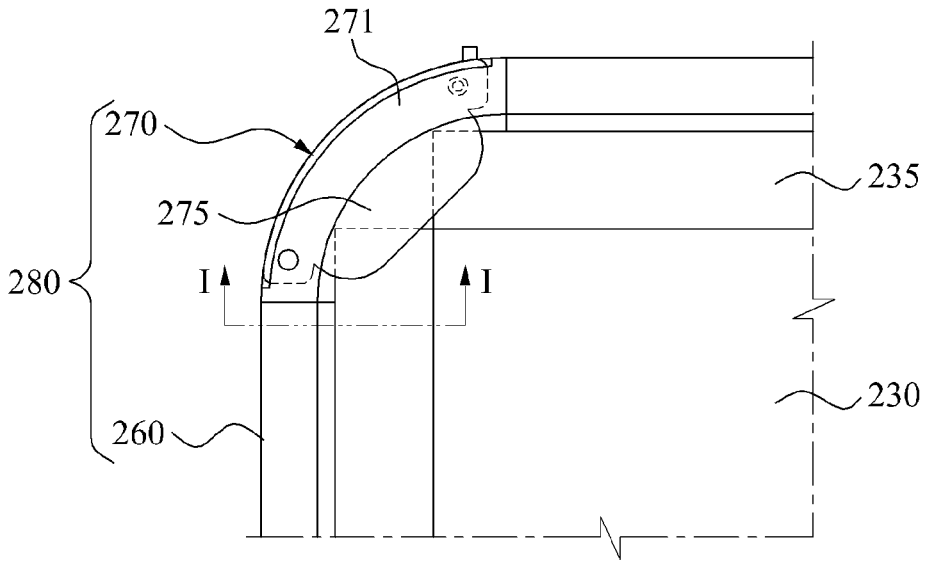
FIGS. 5A and 5B are diagrams illustrating an operation of a portion of the illumination device of FIG. 4 that is magnified to describe a combination structure of the illumination device of FIG. 4.
Figure 5B:
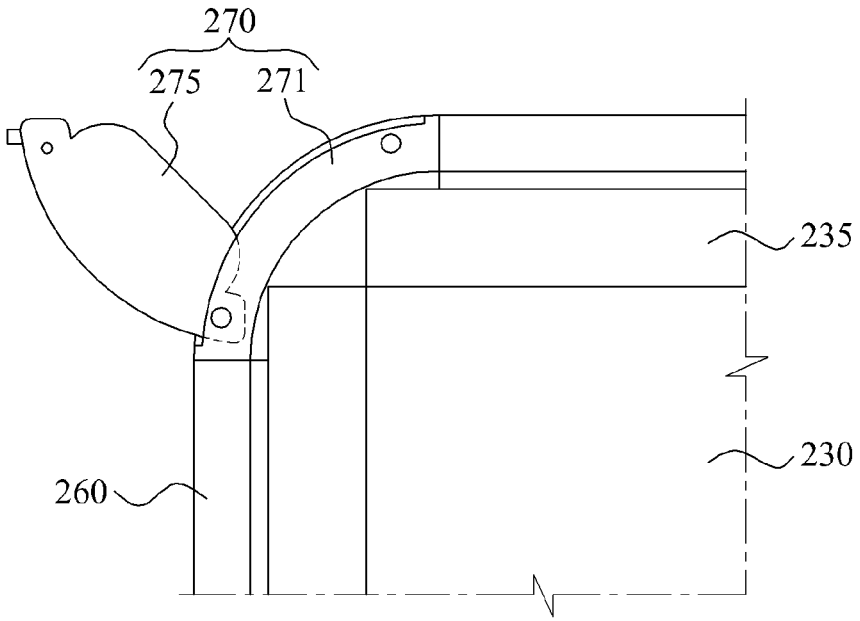
Figure 6:
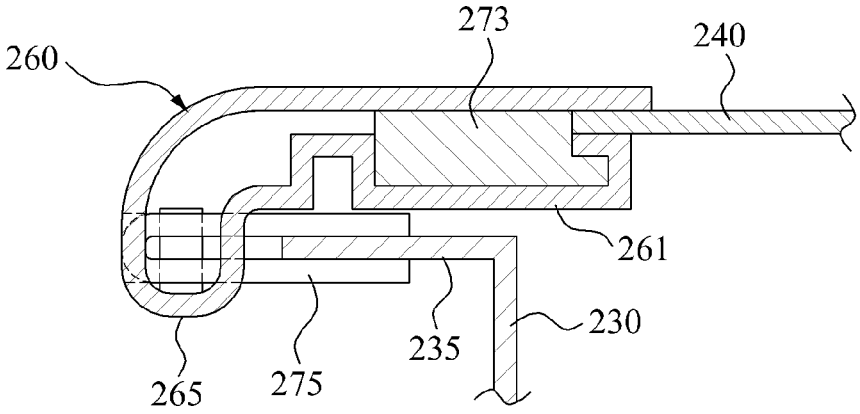
FIG. 6 is a cross-sectional view of a portion cut along line I-I of FIG. 5A.
Figure 7:
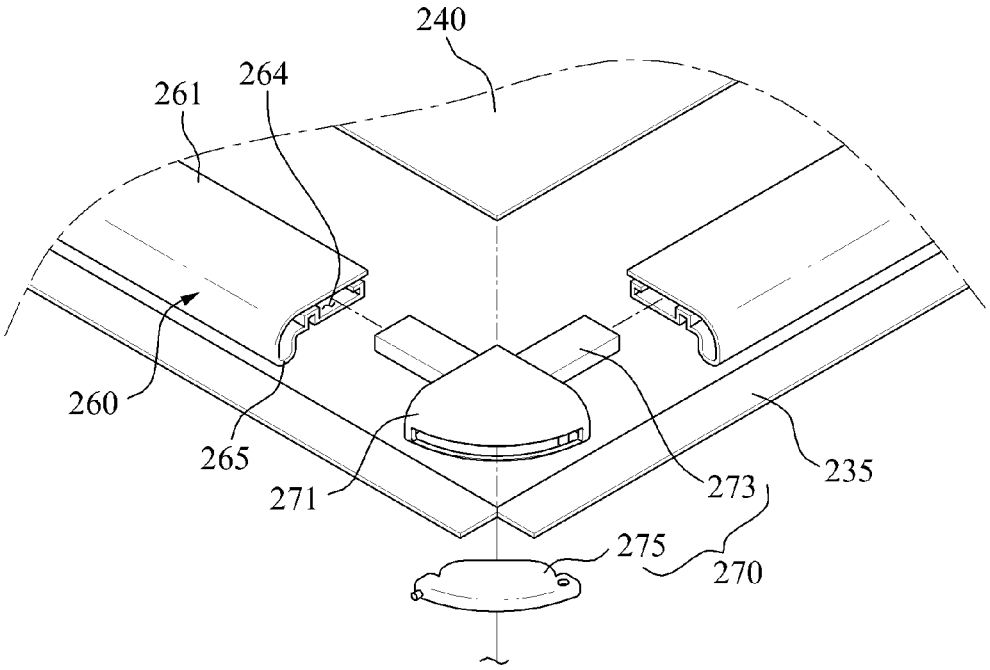
FIG. 7 is an exploded perspective view of a combination module of the illumination device of FIG. 5A.

Hereinafter, an illumination device 200 according to other example embodiments will be described with reference to FIGS. 4 through 7. FIG. 4 illustrates the illumination device 200 according to other example embodiments. FIGS. 5A and 5B illustrate an operation of a portion of the illumination device 200 of FIG. 4 that is magnified to describe a combination structure of the illumination device 200 of FIG. 4. FIG. 6 illustrates a portion cut along line I-I of FIG. 5A. FIG. 7 illustrates a combination module of the illumination device 200 of FIG. 5A.

The illumination device 200 includes a light source 210, a power supply 220, a housing 230, a diffusion cover 240, a power cover 250, and a combination module 280. For ease of description, description of a structure that is similar to, or the same as the structure described with reference to FIGS. 1 through 3 will be omitted, for conciseness, or will be provided as needed.

Referring to FIG. 4, the housing 230 further includes a combination assistance portion 235 that is formed to be adjacent to an open side of the housing 230. The combination assistance portion 235 may be configured to be a flange that extends, from an end portion of an external wall forming the open side of the housing 230, in a direction of an external side of the housing 230 to be vertical to the external wall. However, the configuration is not limited thereto. For example, the combination assistance portion 235 may be configured as an intermittently protruding shape.

The combination assistance portion 235 may be combined with a locking member 270 of the combination module 280 and thus, may assist the diffusion cover 240 and the combination module 280 to be combined with the housing 230. The configuration may not be limited thereto, and may be freely changed when the configuration withstands a weight of the diffusion cover 240 and the combination module 280.

The combination module 280 may include a plurality of connecting portions 260, and locking members 270. The connecting portion 260 may include a body member that is formed to be a long column shape, and the locking member 270 may connect adjacent connecting portions 260 and fix, on the combination assistance portion 235, the diffusion cover 240 connected by the connecting portion 260.

In this example, the body member 261 may include one side formed to be open along a lengthwise direction, and may include an insertion space 264 inside the body member 261. At least one portion of an outline of the diffusion cover 240 is received by the insertion space 264 and thus, may be fixed. The connecting portion 260 and the diffusion cover 240 may be combined with the combination assistance portion 235 by the locking member 270.

Referring to FIG. 6, the body member 261 is configured to receive an external outline of the diffusion cover 240 in the insertion space 264. For example, four connecting portions 260 may receive three external sides of two diffusion covers 240 that are disposed in parallel, and may be combined with the diffusion covers 240 so that the diffusion covers 240 are disposed in predetermined locations.

Even though the body member 261 included in the connecting portion 260 is configured to receive, in the insertion space 264, one end of the outline of the diffusion cover 240, the configuration is not limited thereto. For example, the configuration may be freely changed when the body member 261 reliably holds and is connected with the housing 230 by the locking member 270. For example, the connecting portion 260 may include a holding portion (not illustrated) to hold a portion of an adjacent outline of the diffusion cover 240 and thus, may hold the diffusion cover 240.

Subsequently, end portions of adjacent connecting portions 260 are connected by the locking member 270 as illustrated in FIGS. 5 and 6. Referring to FIG. 6, the locking portion 270 further includes a corner member 271, an insertion member 273, and a lever member 275.

Even though the corner member 271 has a shape of a cross section of a quarter round including two orthogonal sides, the configuration is not limited thereto. For example, the shape of the cross section may be formed to be a quadrangle shape, or a shape of a portion that is obtained by cutting a doughnut shape along two straight lines that are orthogonal and pass a center of the doughnut shape.

The insertion member 273 may extend from the two orthogonal sides of the corner member 271, and may be formed to correspond to the insertion space 264 to be insertion-combined with the insertion space 264 of the connecting portion 260. In this example, two insertion members 273 are formed. The insertion portion 273 may be inserted to the insertion space 264 based on a forced-fit scheme and thus, may connect adjacent connecting portions 260.

The lever member 275 is connected to the corner member 271, and may be formed to be detachable from at least one portion of the combination assistance portion 235. According to example embodiments, the lever member 275 may be hinge-combined with the corner member 271 to be rotatable and thus, the lever member 275 may be combined with the combination assistance portion 235 or detached from the combination assistance portion 235 according to the rotation.

The lever member 275 may be combined with the corner member 271 by inserting at least one portion of the combination assistance portion 235 to the lever member 275 based on the forced-fit scheme. Also, the lever member 275 may be combined with the corner member 271 by inserting the combination assistance portion 235 between a portion of the corner member 271 and the lever member 275, and combining and fixing the locking member 270 and the combination assistance portion 235 when the lever member 275 rotates.

The illumination device 200 may be configured to include the diffusion cover 240 or diffusion cover 240 and the power cover 250 that are combined as a single module, and may be configured to combine the single module with the housing 230 using the locking member 270.

The connecting portion 260 may further include a wing member 265 that extends in an opposite direction to an open side of the body member 261. When the combination module 280 is combined with the housing 230, the wing member 265 may be formed to prevent the combining assistance portion 235 from being visually exposed to a user located in a lower portion of the illumination device 200.

A width of the wing portion 265 extending from the body member 261 may be similar to or may be larger than a width or a length of the combination assistance portion 235 and thus, may cover the combination assistance portion 235.

The illumination device 200 may combine the diffusion cover 240 with the housing 230 without using a separate component such as a screw and thus, may prevent a deformation of a product due to combination using the screw and may provide esthetic satisfaction.

The diffusion cover 240 and the combination module 280 may be detached from the housing 230 by adjusting the lever member 275 and thus, the illumination device 200 may be readily maintained.

Even though the lever member 275 is hinge-combined with the corner member 271, and may be combined with the combination assistance portion 235 according to a rotation, the configuration is not limited thereto. For example, the lever member 275 may be configured based on a push-button scheme. When a button is pushed, the lever member 275 may be fixed, and when the button is pushed again, the lever member 275 may return to its original state. Here, the configuration may be freely changed when the locking member 270 is combined with the combination assistance portion 235 based on a forced fit scheme, without using a separate tool or device.

Figure 8:
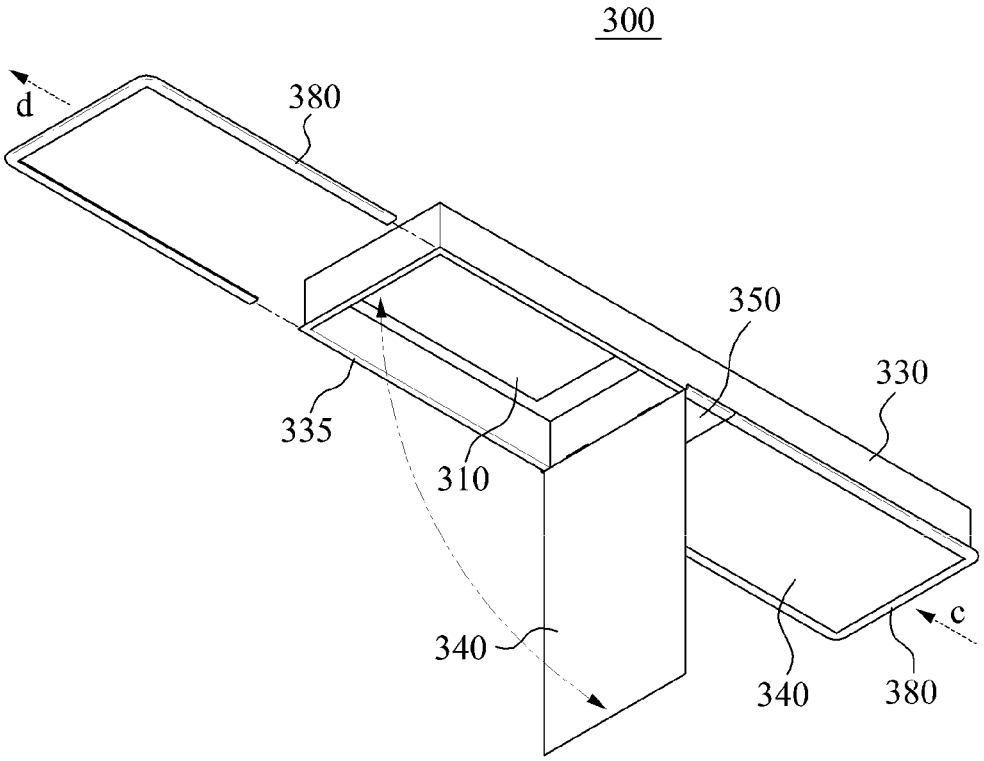
FIG. 8 is a perspective view of an illumination device according to still other example embodiments.

Hereinafter, an illumination device 300 will be described, according to still other example embodiments, with reference to FIGS. 8 through 9. FIG. 8 illustrates the illumination device 300 according to still other example embodiments, and FIG. 9 illustrates a cross section of a combination module that combines a housing and a diffusion cover of FIG. 8.

Figure 9:
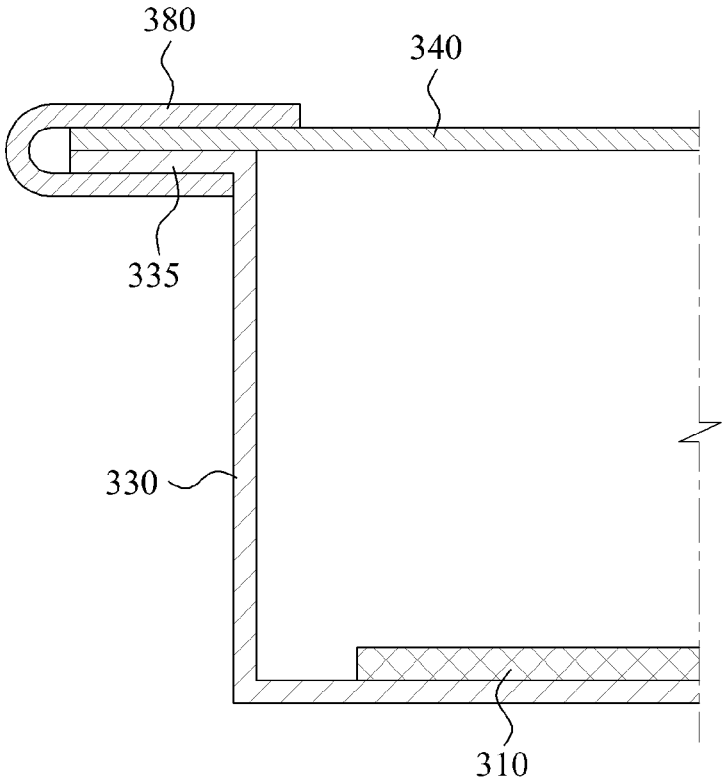
FIG. 9 is a cross-sectional view of a combination module that combines a housing and a diffusion cover of FIG. 8.

Referring to FIGS. 8 and 9, the illumination device 300 includes a light source 310, a power supply, a housing 330, a diffusion cover 340, a power cover 350, and a combination module 380. For ease of description, the description of a structure that is similar to or the same as the structure described with reference to FIGS. 1 through 6 will be omitted, for conciseness, or will be provided when needed.

Referring to FIG. 8, the combination module 380 includes one side formed to be open and includes an insertion space in an internal space of the combination module 380, and may be configured for insertion-combination of an outline of the diffusion cover 340 and the combination assistance portion 335 in the insertion space.

Particularly, the diffusion cover 340 may be formed to be a quadrangle shape, the combination module 380 may be formed to be a shape that receives three adjacent sides, such as a quadrangle having one side formed to be open or a C-shape, and the sides and the combination assistance portion 335 may be sliding-combined in the insertion space.

The combination assistance portion 335 and the diffusion cover 340 are sliding-combined with the insertion space while the combination assistance portion 335 and a portion of the outline of the diffusion cover 340 overlaps the combination assistance portion 335 and thus, the diffusion cover 340 may be combined with the combination assistance portion 335, that is, the diffusion cover 340 may be fixed on the housing 330.

Even though the combination module 380 has a predetermined elasticity to receive and fix the combination assistance portion 335 and the outline of the diffusion cover 340, the configuration is not limited thereto.

As an example, when the illumination device 300 is installed on a ceiling, the open side of the housing 330 is open in a direction of a lower portion. The diffusion cover 340 may be disposed in the housing 330 to cover the open side of the housing 330 and may be combined with the combination assistance portion 335 using the combination module 380.

Here, the diffusion cover 340 and the power cover 350 may be hinge-combined with the housing 330, respectively, to be rotatable.

When the diffusion cover 340 and the combination assistance portion 335 are combined using the combination module 380, and the combination module 380 slides in a direction d and is detached from the housing 330, the diffusion cover 340 may rotate, due to a self-weight, based on a hinge-combination portion to be open. When the diffusion cover 340 is disposed to be in contact with the housing 330, and is combined with the combination module 380 in a direction c, a portion of an outline of the diffusion cover 340 and the combination assistance portion 335 may be received by the combination module 380 and thus, the diffusion cover 340 may be combined with and fixed on the housing 330.

Even though the combination module 380 combines the diffusion cover 340 and the housing 330 based on an insertion-combination of the outline of the diffusion cover 340, the configuration is not limited thereto. For example, the power cover 350 may also be combined with the combination assistance portion 335 or a body of the housing 330 using the combination module 380.

In this example, the illumination device 300 may be readily maintained, and may selectively open the diffusion cover 340 or the power cover 350 with respect to a portion of the housing 330 to maintain a target component and thus, may improve efficiency in maintaining.

Figure 10:
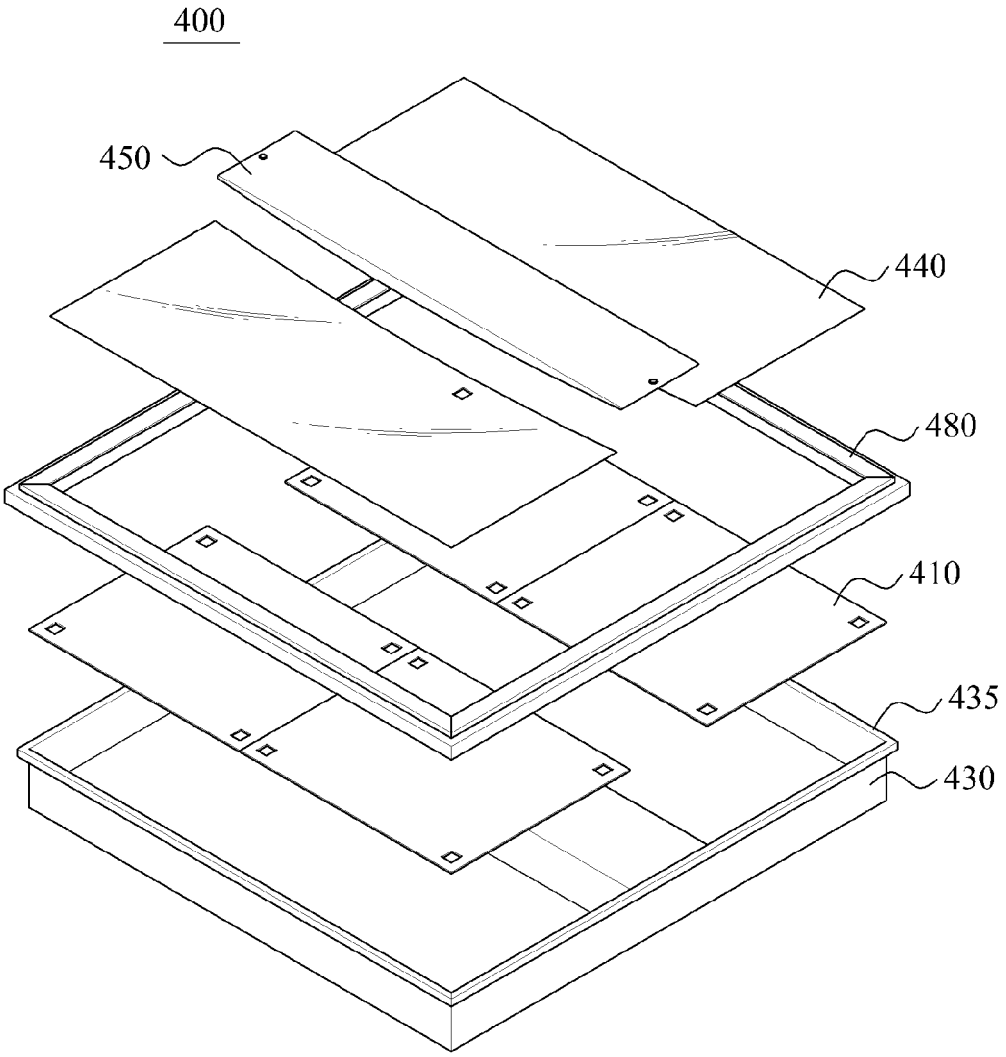
FIG. 10 is an exploded perspective view of an illumination device of yet other example embodiments.

FIG. 10 illustrates an illumination device 400 of yet other example embodiments.

Referring to FIG. 10, the illumination device 400 includes a light source 410, a power supply 420, a housing 430, a diffusion cover 440, a power cover 450, and a combination module 480. For ease of description, description of a structure that is similar to or the same as the structure described with reference to FIGS. 1 through 9 will be omitted, for conciseness, or will be provided as needed.

The light source 410 may be configured as a planar LED module that corresponds to a light emitting device module including a light emitting device on a PCB. Even though the example embodiments may include two planar LED modules, the configuration may not be limited thereto.

The illumination device 400 is generally installed on a ceiling inside a building, the light source 410 and the power supply 420 are received in an internal space of the housing 430, and the diffusion cover 440 is combined, using the combination module 480, with the open side in the lower portion of the housing 430 to face a bottom side. Subsequently, the power cover 450 is combined with the housing 430 to press one side of the diffusion cover 440.

Here, the power cover 450 may be combined with the housing 430 to be detachable and thus, maintenance for the illumination device 400, such as, replacing of the light source 410, repairing of the power supply 420, and cleaning of the internal space of the housing, may be readily performed.

Figure 11:
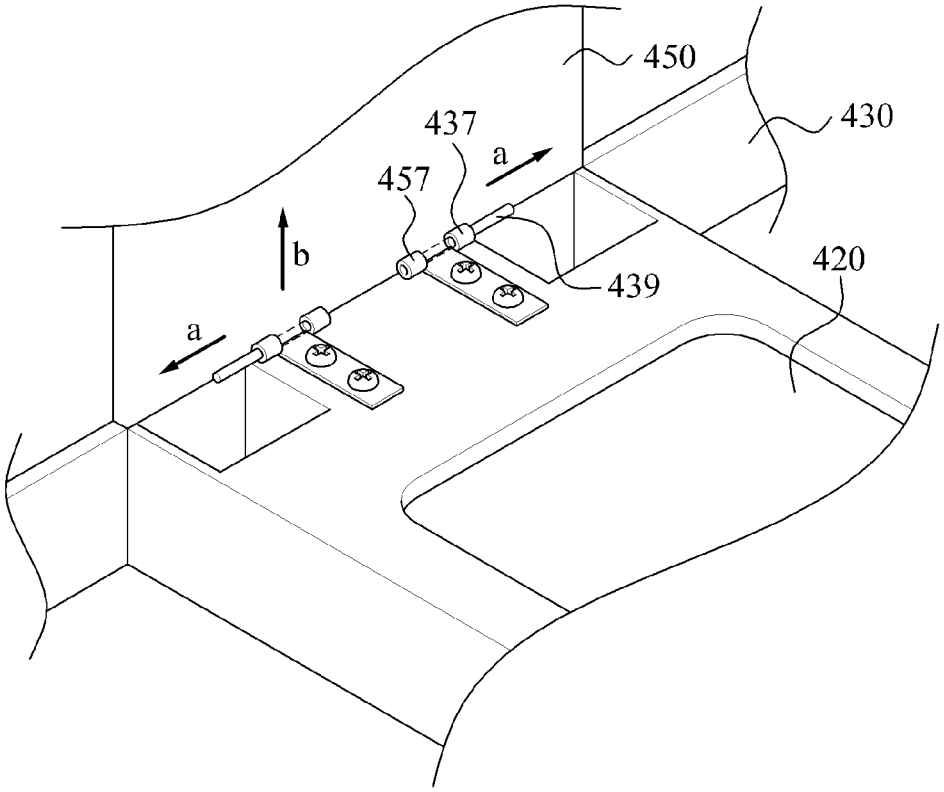
FIG. 11 is a magnified perspective view of a combination relationship between a power cover and a housing of FIG. 10.

FIG. 11 illustrates a combination relationship between a power cover and a housing of FIG. 10.

Referring to FIG. 11, the power cover 450 is combined with the housing 430 to be rotatable and detachable.

The power cover 450 includes, in a portion where the power cover 450 combines with the housing 430, a rotation assistance portion 457 formed to be a tube shape an inside of which is penetrated, and the housing 450 includes a rotation combination portion 437 similar to the rotation assistance portion 457. A pin 439 having a stick shape is received by the rotation assistance portion 457 and the rotation combination portion 437 and thus, the power cover 450 may be combined with the housing 430 to be rotatable.

In this example, the pin 439 may be configured to be detachable from at least one of the rotation assistance portion 457 and the rotation combination portion 437. When the pin 439 moves towards a direction a, a combined structure of the power cover 450 and the housing 430 is released and thus, the power cover 450 may be configured to be detachable in a direction b from the housing 430.

Hereinafter, operations for maintaining and repairing the light source 410 will be described with reference to FIGS. 10 and 11. When the power cover 450 opens, and the power cover 450 is detached from the housing 430 by detaching the pin 439 from at least one of the rotation assistance portion 457 and the rotation combination portion 437.

Subsequently, the diffusion cover 440 may be detached by separating the combination module 480 included in the illumination device 400 from the housing 430.

The light source 410 may be changed and the housing 430 may be repaired or cleaned by readily detaching the light source 410 from the housing 430 so that the illumination device 400 may be readily maintained and repaired without a separate tool. Also, the power cover 450 may perform rotary opening and closing and may be detachable and thus, when the power supply 420 is maintained and repaired, a user may secure a relatively larger space for maintaining and repairing and may readily access the power supply 420 without a separate tool.

Even though the rotation assistance portion 457, the rotation combination portion 437, and the pin 439 are included to combine the housing 430 and the power cover 450, the configuration may not be limited thereto. For example, the configuration may be freely changed when the power cover 450 is rotatable with respect to the housing 430 to be opened and closed and is detachable.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An illumination device, comprising:

a light source including two planar light-emitting modules;

a power supply to supply power to the light source, the power supply being disposed between the two planar light-emitting modules;

a housing including one side formed to be open, and including the light source and the power supply in the housing;

at least one diffusion cover, disposed on the open side of the housing, through which light from the light source passes; and a power cover, disposed on the open side of the housing to cover one side of the power supply.

2. The illumination device of claim 1, wherein the power cover is combined with the housing to open and close.

3. An illumination device, comprising:

a light source;

power supply to supply power to the light source;

a housing including one side formed to be open, and including the light source and the power supply in the housing;

at least one diffusion cover, disposed on the open side of the housing, through which light from the light source passes; and a power cover, disposed on the open side of the housing, to cover one side of the power supply, wherein:

the power cover is formed to overlap an at least one portion of the at least one diffusion cover when the housing is closed.

4. The illumination device of claim 3, wherein a portion of the power cover overlapping the at least one portion of the at least one diffusion cover is formed to protrude into an internal space of the housing, and presses the at least one diffusion cover when the housing is closed.

5. The illumination device of claim 3, wherein the power cover is combined with the housing to open and close.

6. An illumination device, comprising:

a light source;

a power supply to supply power to the light source;

a housing including the light source and the power supply in the housing, including one side formed to be open, and including a combination assistance portion that includes a flange extending outward from a wall of the housing adjacent to the open side;

at least one diffusion cover, disposed on the open side of the housing, through which light from the light source passes;

a power cover, disposed on the open side of the housing, to cover one side of the power supply; and a combination module to combine the at least one diffusion cover with the combination assistance portion, wherein the combination module is configured to combine the at least one diffusion cover with the combination assistance portion, or to combine the at least one diffusion cover and the power cover with the combination assistance portion.

7. The illumination device of claim 6, wherein the combination module comprises:

a plurality of connecting portions, each connecting portion formed to be a long column shape that is long in one direction, and including a body member combined with at least one of the at least one diffusion cover and the power cover; and locking members to connect the plurality of connecting portions that are adjacent to each other, and fixing the plurality of connecting portions on the combination assistance portion.

8. The illumination device of claim 7, wherein the connecting portion further comprises a wing member extending from one side of the body member, and the wing member prevents the combination assistance portion from being visually exposed at a predetermined direction when the combination module is combined with the housing.

9. The illumination device of claim 7, wherein each locking member comprises:

a corner member having a shape of a cross section including a quarter round or two sides that are orthogonal;

two insertion members extending from the corner member to be orthogonal each other, and inserted to insertion spaces of corresponding connecting portions; and a lever member connected to the corner member, and formed to be detachable from at least one portion of the combination assistance portion.

10. The illumination device of claim 9, wherein the lever member is combined, with the corner member, to be rotatable, and is combined with the combination assistance portion or detached from the combination assistance portion according to the rotation.

11. The illumination device of claim 9, wherein the two insertion members are inserted to the insertion spaces based on a forced-fit scheme, and connect the connecting portions.

12. The illumination device of claim 5, wherein the combination module includes one side formed to be open and has an insertion space inside the combination module, and inserts and combines, with the insertion space, at least one of an outline of the at least one diffusion cover and an outline of the combination assistance portion.

13. The illumination device of claim 12, wherein each diffusion cover is formed to be a quadrangle shape, the combination module is formed to have a shape that receives adjacent three sides of the diffusion cover, and the sides and at least one portion of the combination assistance portion are sliding-combined with the insertion space.

* * * * *